US012031728B2

(12) United States Patent
Johnson et al.

(10) Patent No.: US 12,031,728 B2
(45) Date of Patent: Jul. 9, 2024

(54) GAS FIRED WINDOW HEATER

(71) Applicant: The Blossman Companies, Inc., Ocean Springs, MS (US)

(72) Inventors: Jessie W. Johnson, Asheville, NC (US); Gary M. Sly, D'Iberville, MS (US); Jacob S. Weidie, Asheville, NC (US); Albert Keith Teakell, Jenks, OK (US)

(73) Assignee: The Blossman Companies, Inc., Ocean Springs, MS (US)

( * ) Notice: Subject to any disclaimer, the term of this patent is extended or adjusted under 35 U.S.C. 154(b) by 490 days.

(21) Appl. No.: 17/426,496

(22) PCT Filed: Feb. 4, 2020

(86) PCT No.: PCT/US2020/016600
§ 371 (c)(1),
(2) Date: Jul. 28, 2021

(87) PCT Pub. No.: WO2020/163348
PCT Pub. Date: Aug. 13, 2020

(65) Prior Publication Data

US 2022/0099308 A1 Mar. 31, 2022

Related U.S. Application Data

(60) Provisional application No. 62/801,369, filed on Feb. 5, 2019.

(51) Int. Cl.
*F24D 15/02* (2006.01)
*F24H 3/08* (2022.01)
(Continued)

(52) U.S. Cl.
CPC ..... *F24D 15/02* (2013.01); *F24H 3/087* (2013.01); *F24H 9/0063* (2013.01); *F24H 9/0073* (2013.01); *F24H 9/02* (2013.01)

(58) Field of Classification Search
CPC ..... F24D 15/02; F24H 3/087; F24H 9/0063; F24H 9/0073; F24H 9/02
(Continued)

(56) References Cited

U.S. PATENT DOCUMENTS 2,864,359 A * 12/1958 Vaughn ..... F24H 3/105 126/104 A
3,199,580 A * 8/1965 Vaughn ..... F24F 1/031 165/122
(Continued)

FOREIGN PATENT DOCUMENTS

| | | | |
|---|---|---|---|
| CN | 2564915 | Y | 8/2003 |
| CN | 103175254 | A | 6/2013 |
| WO | 2008040051 | A1 | 10/2008 |

OTHER PUBLICATIONS

International Search Report for corresponding PCT/US2020/016600 mailed May 14, 2020.
(Continued)

*Primary Examiner* — Avinash A Savani
(74) *Attorney, Agent, or Firm* — Sandberg Phoenix & von Gontard, P.C.

(57) ABSTRACT

A heater is disclosed that is installed in a window opening in a room for heating the room. The heater has a cabinet having an inner and an outer cabinet with an air gap therebetween, with a heating chamber in the inner cabinet. A burner is provided that is located on an outside wall of the heater. The burner has an inlet and an outlet with a combustion nozzle therebetween, with the burner outlet in communication with a respective serpentine heat exchange tube within said heating chamber where the heat exchange tube receives the hot products of combustion from its burner and discharges the products of combustion to the atmosphere. The heater has a blower that draws air from within the room and forces the air over and around the heat exchange tube(s)
(Continued)

within the heating chamber discharges the heated air back into the room.

20 Claims, 6 Drawing Sheets

(51) Int. Cl.
*F24H 9/00* (2022.01)
*F24H 9/02* (2006.01)

(58) Field of Classification Search
USPC ..... 237/53
See application file for complete search history.

(56) References Cited

U.S. PATENT DOCUMENTS 3,606,150 A * 9/1971 Vaughn ..... F24H 9/0005 236/20 R
4,541,561 A * 9/1985 Smith ..... F24D 5/04 237/53
5,664,555 A * 9/1997 Maschhoff ..... F24H 3/087 126/91 A
2010/0025485 A1* 2/2010 Kaneiwa ..... F24D 19/0087 237/53

OTHER PUBLICATIONS

Written Opinion for corresponding PCT/US2020/016600 mailed May 14, 2020.

* cited by examiner

GAS FIRED WINDOW HEATER

CROSS-REFERENCE TO RELATED APPLICATIONS

This application is the U. S. National Stage under 35 USC § 371 of International Application No. PCT/US2020/016600, filed on Feb. 4, 2020, which claims priority to U.S. Provisional Application No. 62/801,369, filed on Feb. 5, 2019, which is herein incorporated by reference in its entirety.

STATEMENT REGARDING FEDERALLY SPONSORED RESEARCH OR DEVELOPMENT

Not Applicable.

BACKGROUND OF THE DISCLOSURE

This disclosure relates to a propane or gas-fired heater that may be installed in a window of a room to supply heat to a room (or to another enclosure) in a more efficient and economical manner than conventional room heaters. Oftentimes a room may be added to a home or other building where the main heating system for the home may not be capable of heating the addition or where the ducting or hot water heat from the main heating system of the home cannot be economically be added to the new room, but yet a source of heat for the room is necessary if the room is to be used during cold weather. Heretofore, portable heaters, typically electrical heaters, were used as a source of heat for such rooms. While room gas heaters are known, they should (or must) be vented to the atmosphere for safe operation. Wall mounted room heaters are known, which may be electrical or gas fired. However, such wall room mounted heaters are attached to the wall of the room and may not be readily removed without repairs to the wall. In the case of gas-fired wall heaters, openings must be cut through the wall of the room to allow the products of combustion to be vented to the atmosphere and, in some cases, for outside air to be used as combustion air.

SUMMARY OF THE DISCLOSURE

In accordance with the instant disclosure, a room heater is described having a cabinet that is adapted to be installed in a conventional window of a room or the like. The heater has one or more tubular heat exchanger therewithin, and one or more burners, preferably in-shot burners, for combusting a gaseous fuel, preferably propane. The burners introduce heat and hot products of combustion into the tubular heat exchangers. The products of combustion flow through the tubular heat exchangers and are exhausted to the atmosphere. The room heater has a heating chamber in which the tubular heat exchangers are located. A blower is provided for introducing air from within the room (or outside air) into the heating chamber to be heated by the tubular heat exchangers and for discharging the heated air into the room.

The provision of such a window heater that may be sealably installed in a window of a room to be heated in much the same manner as a window air conditioner may be installed in a window.

The provision of such a window heater that may be readily installed in a room (or may be removed from the room) without making any changes to the room or to the window or without making an opening in the wall of the room to vent the heater and/or to utilize outside air for combustion purposes.

The provision of such a window heater that is much more efficient and economical than portable or wall mounted electrical units.

The provision of such a window heater propane fuel may be supplied to the heater from a suitable portable liquid propane container, such as a 15 or 20 pound pressurized container of liquid propane that is typically used with gas-fired barbecue grills or the like, so that the heater and its fuel supply may be readily moved from one room or building to another wherever heat is required.

The provision of such a window heater of the present disclosure where the heater may have a BTU capacity ranging between about 20,000-30,000 BTU/hour.

The provision of such a window heater in which the heat exchange tubes are M-shaped and are arranged generally in one or more horizontal planes with a blower in the front of the heater for drawing room air into the heater, for blowing room air over the M-shaped burner tubes in a direction perpendicular to the proximate ends and along the straight runs of the burner tubes so as to efficiently transfer heat from the tubes to the air moving over the tubes, and for discharging the heated air back into the room.

The provision of such a window heater that uses outside air for combustion air thus rendering the heater more efficient.

The provision of such a window heater that in a preferred embodiment utilizes double wall construction for its cabinet so that the cabinet will remain cool to the touch (or otherwise will remain within safe temperature limits) so that the unit will not injure persons who may touch the cabinet and/or will not damage the window or surrounding structure.

The provision of such a window heater that utilizes an induced draft combustion system that uses "in-shot" burners.

The provision of such a window heater where the burners are accessible from the exterior of the room when the heater is installed in a window such that the burners are sealed and isolated from the room.

The provision of such a window heater in which the products of combustion are exhausted to the atmosphere without the necessity of providing a special opening in the wall of the room.

The provision of such a window heater that may either recirculate inside air to maximize heating or heat outside air to enhance indoor air quality.

The provision of such a heater that is thermostat controlled.

Other objects and features of the window heater of the present disclosure will be in part apparent and in part herein expressly disclosed.

BRIEF DESCRIPTION OF THE FIGURES

Corresponding reference characters indicate corresponding parts throughout the several views of the drawings.

DESCRIPTION OF PREFERRED EMBODIMENT

Figure 1:
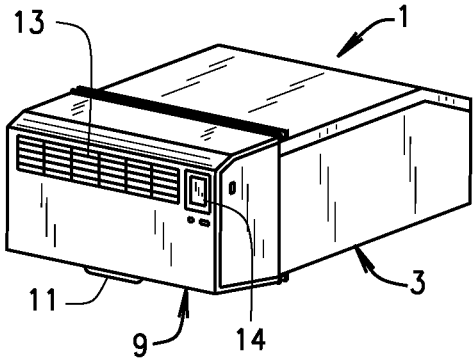
FIG. 1 is a perspective view of a window heater of the present disclosure illustrating a heater cabinet in its assembled state.
Figure 2:
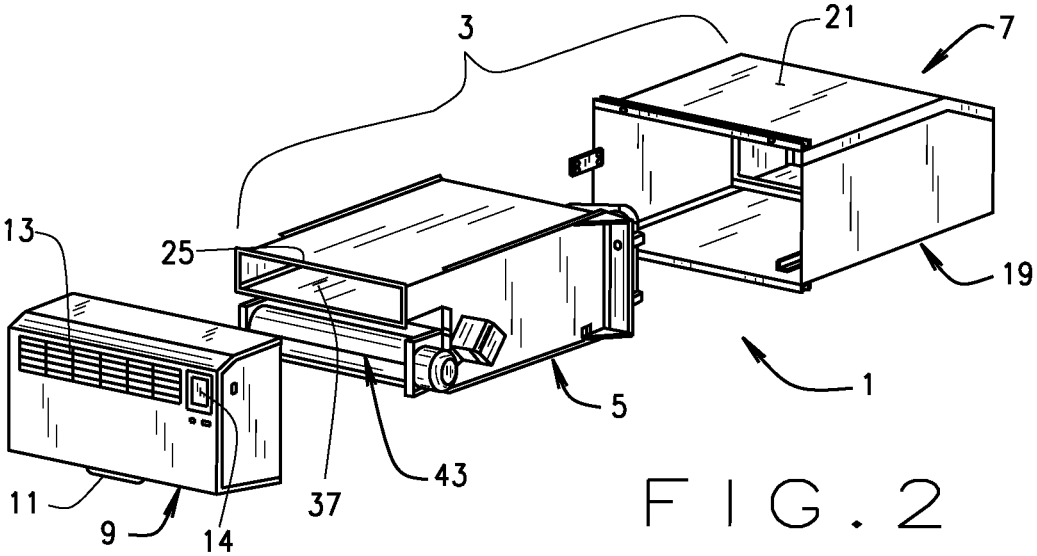
FIG. 2 is an exploded perspective view of the window heater, as shown in FIG. 1, illustrating an inner cabinet having a heating chamber within which one or more tubular heat exchangers (not shown in FIG. 2) are housed, the heater has a blower for drawing room air into the heating chamber to be heated by the heat exchangers, and for discharging heated air back into the room.

Referring now to the drawings, the overall construction of a window heater of the present disclosure, as generally indicated in its entirety at 1, comprises a cabinet 3, which includes an inner cabinet 5 and an outer cabinet 7. As shown in FIG. 2, the inner cabinet 5 is received within the outer cabinet 7 so that the cabinet 3 is of double wall construction with an air gap between the inner and outer cabinets for maintaining the temperature of the outer cabinet below a temperature level that could injure a person coming in contact with the outer cabinet or that pose a fire hazard if the outer cabinet comes into contact with wood or other building materials. A front cover 9 is removably attached (e.g., snaps into place) on the front of cabinet 3, which has an air intake opening 11 at its bottom and an air discharge opening 13 at its top. The function of these openings will be described hereinafter. The front cover has a control panel 14 for controlling operation of the heater. Preferably, the front cover is an injection molding made of a suitable plastic material.

Figure 3:
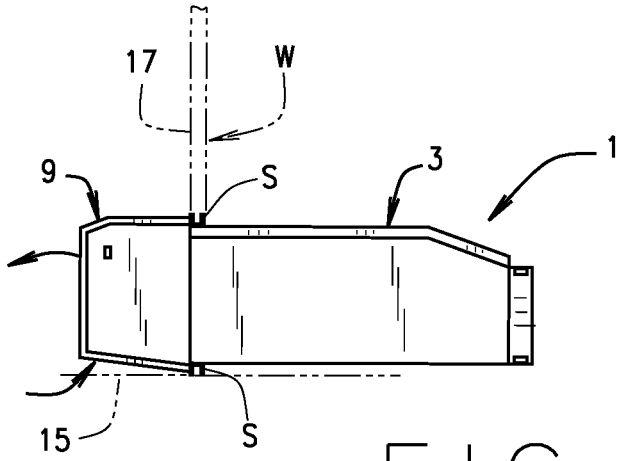
FIG. 3 is a side elevational view of the assembled window heater of FIG. 1 further illustrating how the window heater is installed in a window opening of a room with the bottom of the heater resting on a window sill and with the sash window lowered to contact and seal the top of the cabinet.

As best shown in FIG. 3, cabinet 3 is constructed to be installed in a window opening of a window W in a room of a house or the like. The bottom of the cabinet 3 is configured to rest on a horizontal window sill 15 of the window opening. Preferably, the window W has a vertically movable window sash 17 that is adapted to be lowered to engage the top on of cabinet 3 in much the same manner as a window air conditioner is installed. It will be understood that side panels (not shown) may be furnished with the window heater to close the side spaces between the sides of cabinet and the sides of the window opening. A seal S is provided between the bottom edge of the window sash 17 and the upper surface of outer cabinet 7 and between window sill 15 and the bottom wall of the outer cabinet. It will be understood that if the window W is not a window that has a sill and a vertically movable sash; other structure may be provided for effectively sealing heater 1 within the window opening. The window heater 1 is typically installed in a room that has a window W at the time the heater is purchased so that, in accord with the present invention, no additional opening is required for venting of the combustion gases to the atmosphere. However, if the room in which heater 1 is to be installed has no window W, it will be necessary to provide a suitable opening to receive the heater by cutting an opening of the required size in an outside wall and casing the opening to receive the heater. However, no additional opening is required to vent the combustion products to the atmosphere.

Figure 4:
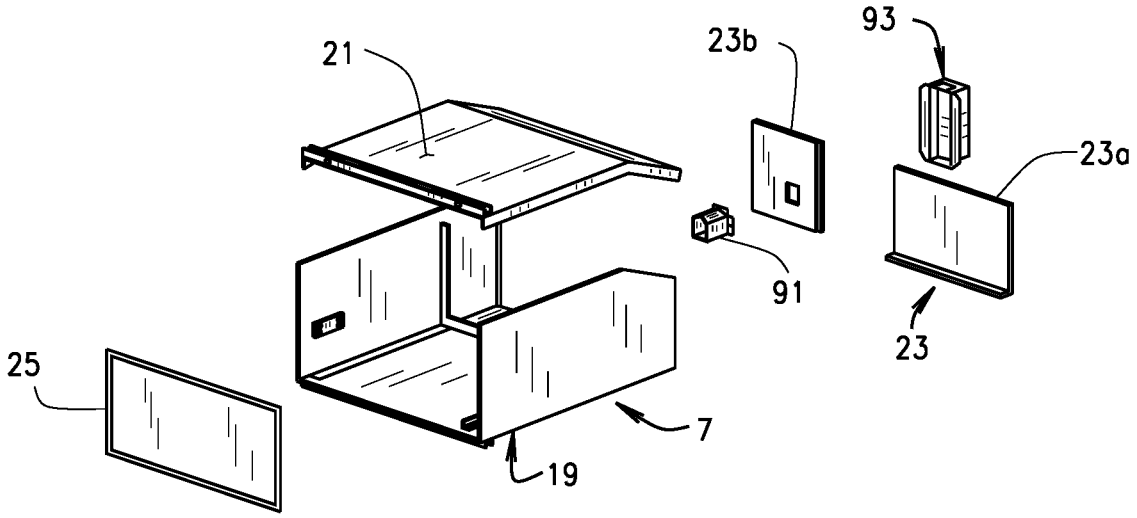
FIG. 4 is an exploded, perspective view of the outer cabinet shown in FIG. 1.

Referring now to FIG. 4, the construction of the outer cabinet 7 will be described. The outer cabinet has a sheet metal bottom and side wall assembly 19. A sheet metal top panel 21 and a sheet metal back wall 23 made of back wall panels 23*a*, 23*b* completes the outer cabinet. A gasket 25 of a suitable gasket material, such as an EPDM (ethylene propylene diene monomer)/Neoprene foam material or the like, is provided at the front of the outer cabinet 7 to seal against the rear of front cover 9.

Figure 5:
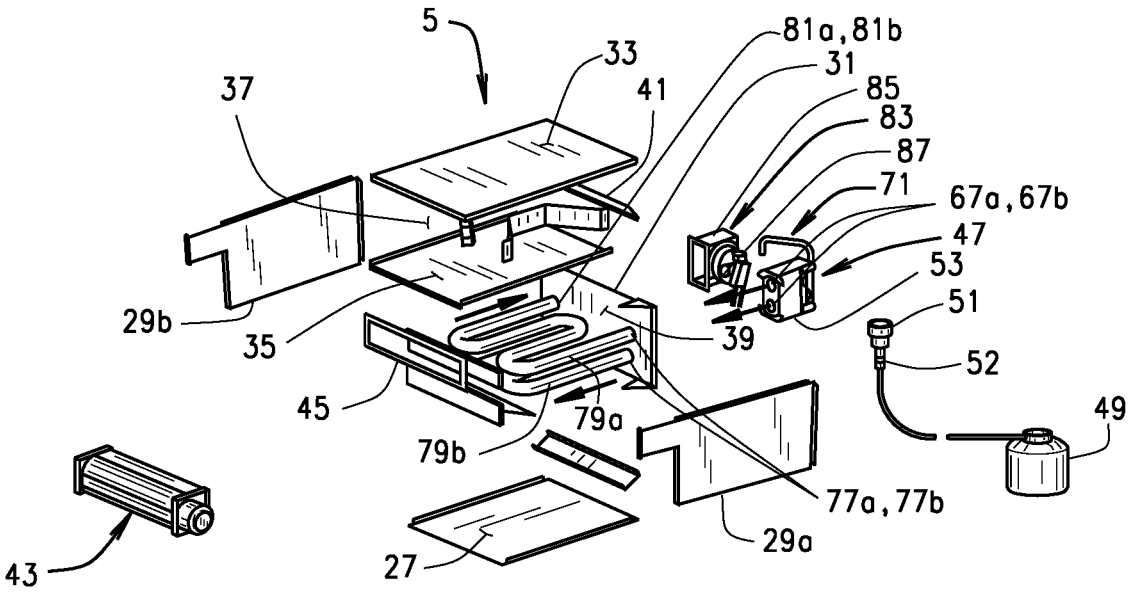
FIG. 5 is an exploded, perspective view of the inner cabinet illustrating the major components located within or attached to the inner cabinet.
Figure 6:
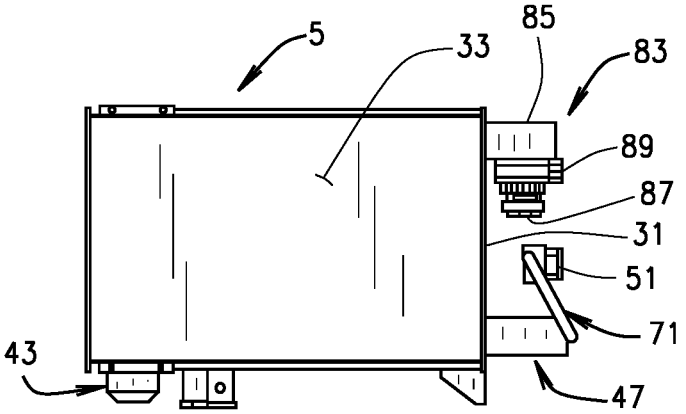
FIG. 6 is a top plan view of the inner cabinet.
Figure 7:
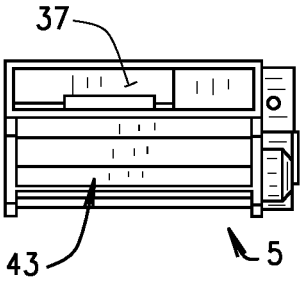
FIG. 7 is a side elevational view of the inner cabinet shown in FIG. 6.
Figure 8:
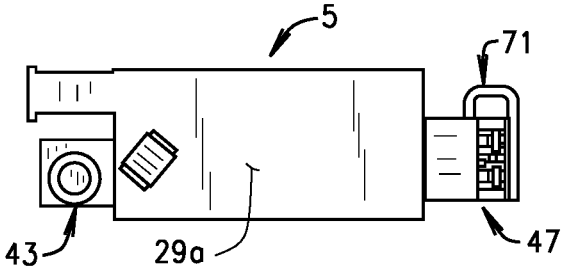
FIG. 8 is a is a front elevational view of FIG. 7.

In FIG. 5, the construction of the inner cabinet 5 and its associated components is shown. The inner cabinet is, in effect, a sheet metal box having a floor 27, opposed sides 29*a*, 29*b*, a back wall 31, and a top wall 33. A horizontal partition or wall 35 is disposed within the inner cabinet and is spaced downwardly from top wall 33 to form an air discharge passageway 37 and a heating chamber 39 within the inner cabinet. An inclined deflector wall 41 is disposed at the rear of the inner cabinet for directing heated air discharged from the heating chamber 39 into the discharge passage 37 for discharge of heated air back into the room via the air discharge vent 13 in front cover 9. It will be understood that the various sheet metal panels comprising the inner and outer cabinets 5 and 7 may be riveted or welded together.

A blower 43 is mounted in the lower front of inner cabinet 5 in communication with the air intake opening 11 in front cover 9 for drawing air from within the room in which heater 1 is installed and for forcing this air into heating chamber 39 to be heated and for forcing heated air from within the heating chamber into discharge passageway 37 so as to be discharged back into the room via air discharge opening 13 in the front cover. It will be understood that in the normal operational mode of heater 1, blower 43 only circulates room air through heater 1, but outside air could also be drawn into the room to maintain a desired indoor air quality. Blower 43 preferably may be a cross-flow, centrifugal blower having an elongate blower wheel mounted horizontally in communication with air inlet 11 in front cover 9, such as a Model TGA 80/1-420 Blower, commercially available from company, Fergas North America, 10814 Coldwater Road, Ft. Wayne, Indiana. An intake opening seal 45 is provided between the lower front of the inner cabinet 5 and the rear of the front cover 9 to substantially seal the air intake opening 11 between the inner cabinet and the front cover. It will be understood, that the various walls of the inner and outer cabinets 5 and 7 may be riveted or otherwise joined together.

As further shown in FIG. 5, a gas burner assembly 47 is mounted on the exterior of back wall 31 of the inner cabinet 5. The gas burner assembly is supplied with a gaseous fuel, preferably propane but natural gas may also be used, which may be supplied, for example, from a portable tank 49 or other source of liquid propane (not shown). Such portable liquid propane tanks are well known for use with outdoor barbecues and with recreational vehicles. However, in accord with this disclosure, rather than using a portable propane tank as a fuel supply, heater 1 may be connected to a main source of propane or natural gas for a more permanent installation. A conventional pressure regulator 51 is interposed between the liquid propane tank 49 and a gas inlet to the burner assembly 47 so as to supply gaseous propane to burner assembly 47 at a desired pressure (e.g., 11" Water Column Height, or about 0.4 psig or about 2.76 kpa). A connect/disconnect coupler 52 is provided so that the tank 49 may be readily connected and disconnected from the pressure regulator. As noted above, in lieu of the portable tank 49, the fuel supply may be a propane or natural gas supply line that supplies propane or natural gas to other appliances within the home such that tank 49 is not needed. However, by being able to be used with the portable tank 49, the window unit may be quickly installed within a window W and connected to the tank so that heat may be provided to the room within a few minutes and so that heater 1 can be readily moved to other locations.

Figure 16:
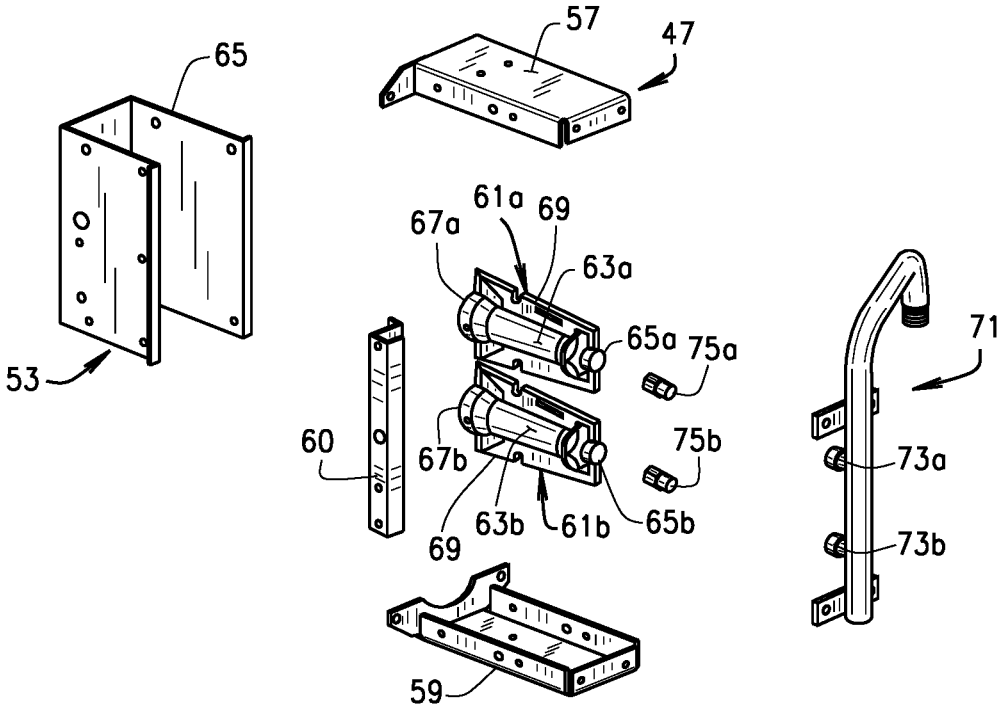
FIG. 16 is an exploded, perspective view of the burner assembly.
Figure 17:
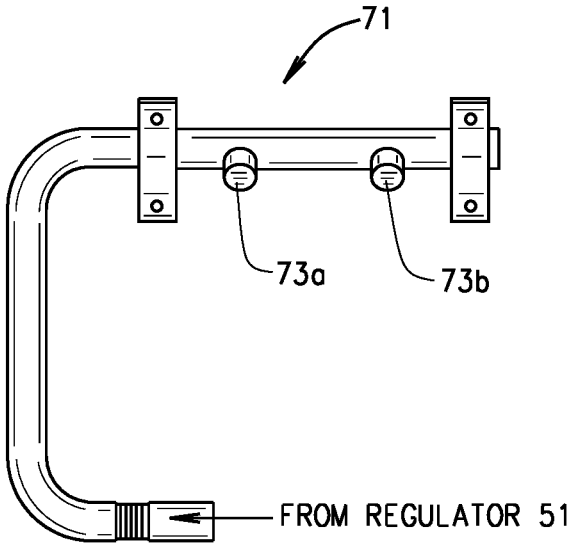
FIG. 17 is a view, on a somewhat larger scale, of a gas manifold assembly to be used with the burner assembly.

The details of burner assembly 47 are shown in FIGS. 11-17. As shown in FIG. 16, the burner assembly comprises a burner housing or box 53 of suitable sheet metal or the like. As best shown in FIG. 16, the burner housing 53 has a U-shaped main housing 55 having a top 57 and a bottom 59. A vertically oriented burner mounting rail 60 is installed within housing 53 to which a pair of in-shot propane burners 61*a*, 61*b* is mounted. Each of these burners has a tubular burner body or expansion nozzle 63*a* or 63*b*, each of which has a respective gas inlet 65*a*, 65*b* and a respective flame outlet 67*a*, 67*b*. A vertically disposed mounting flange 69 is provided on each burner 61*a*, 61*b* for mounting the burners on mounting rail 60. A supply manifold, as generally indicated at 71, is supplied with gaseous propane from regulator 51 and has a respective gas outlet 73*a*, 73*b* for supplying gaseous fuel to each burner 61*a*, 61*b*. An orifice 75*a*, 75*b* is interposed between each manifold outlet and its respective burner gas inlet to supply gas (e.g., propane or natural gas) to each burner in the proper ratio with combustion air to be burned within the burner expansion nozzles 63*a*, 63*b* for the efficient combustion. It will be understood that once a flame has been established in each of the burners 61*a*, 61*b*, combustion air from the exterior of the heater 1 will be drawn into the burner expansion nozzles in the proper proportion with the gas to efficiently burn. As shown best in FIG. 5, the hot products of combustion are discharged from flame outlets 67*a*, 67*b* of nozzles 63*a*, 63*b* into inlets 77*a*, 77*b* of a pair of M-shaped heat exchange tubes 79*a*, 79*b* that are horizontally disposed within heating chamber 39.

Figure 9:
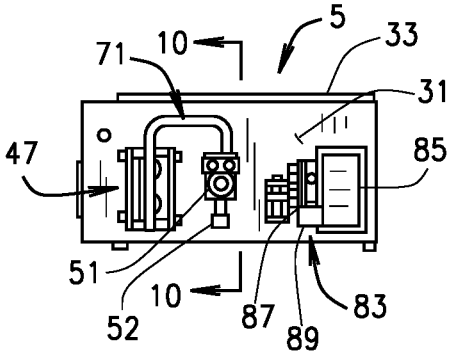
FIG. 9 is rear elevational view of FIG. 7.
Figure 10:
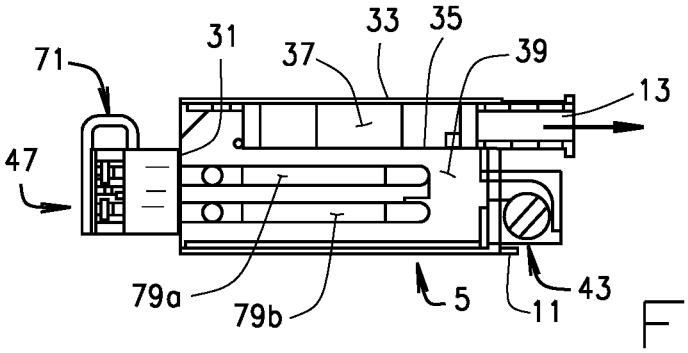
FIG. 10 is a longitudinal cross-sectional view of the inner cabinet taken along section line 10-10 of FIG. 9.
Figure 11:
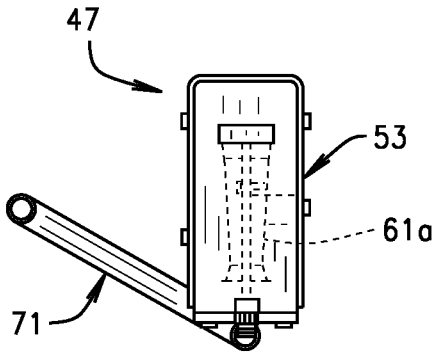
FIG. 11 is a top plan view of the burner assembly with portions of the burner housing shown in cross section for purposes of illustration and showing a gas manifold connected to a pair of in-shot burners (only one of which is shown in FIG. 11) housed within the burner housing.
Figure 12:
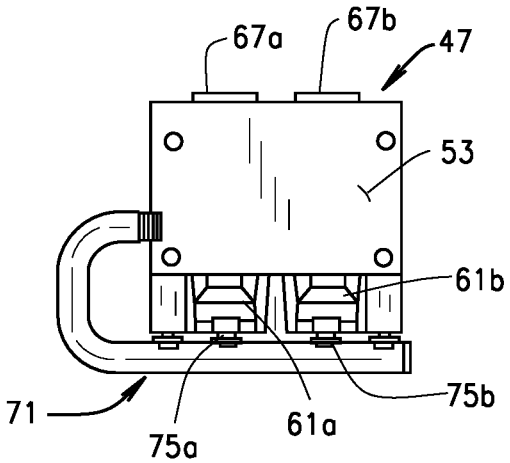
FIG. 12 is left side elevational view of the burner assembly, as shown in FIG. 11.
Figure 13:
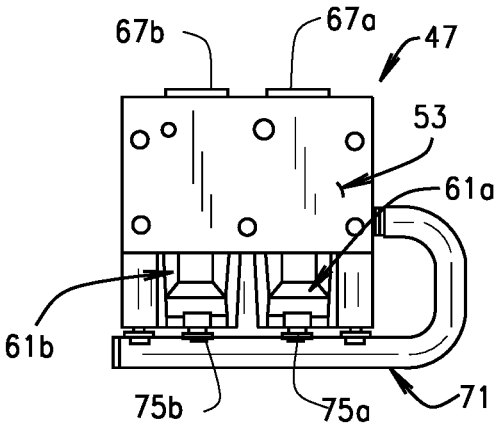
FIG. 13 is a right side elevational view of the burner assembly, as shown in FIG. 11.
Figure 14:
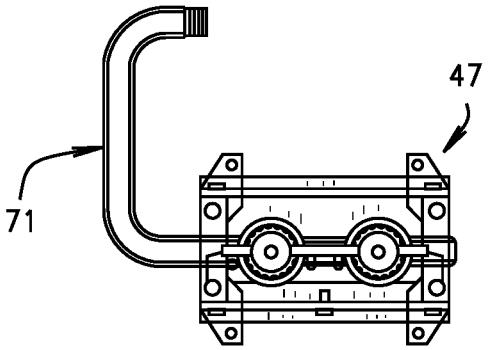
FIG. 14 is a front view of the burner assembly shown in FIG. 12.
Figure 15:
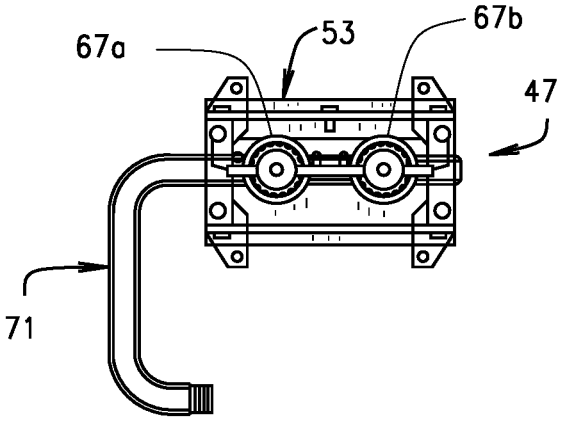
FIG. 15 is a rear view of the burner assembly shown in FIG. 12.

As further shown in FIG. 5, each heat exchange tube 79*a*, 79*b* is of a serpentine configuration so as to increase its effective length within the heating chamber 39 thereby to insure that as much heat as possible is transferred from the products of combustion flowing through the heat exchange tubes to the air flowing through the heat exchange chamber. Each heat exchange tube 79*a*, 79*b* has a respective outlet end 81*a*, 81*b* connected to an exhaust gas collector box and fan assembly 83. The exhaust gas collector box and fan assembly 83 forcibly draws the products of combustion from burners 61*a*, 61*b* through each of the heat exchange tubes 79*a*, 79*b* and into a collector box 85, to which an exhaust gas fan 87 is connected. More particularly, exhaust fan 87 draws the exhaust gases and products of combustion through heat exchange tubes 79*a*, 79*b* and into collector box 85. The fan 87 has an outlet 89, as best shown in FIG. 9, which discharges the exhaust gases into an exhaust air chute extension 91 (as shown in FIG. 4) carried by back wall 23*b* of the outer cabinet 7 so that the exhaust gases from the outlets 81*a*, 81*b* of heat exchange tubes 79*a*, 79*b* are discharged into an exhaust flue 93 from which the exhaust gases are exhausted to the atmosphere clear of the heater 1 and outside of the room in which heater 1 is installed. It will be appreciated that the interior of flue 93 may be provided with suitable thermal insulation to maintain the temperature of the exterior surfaces of the flue at a sufficiently low temperature as to avoid a fire hazard if the flue should come into contact with combustible building materials or so as to prevent injury to a person touching the flue being burned.

Figure 18:
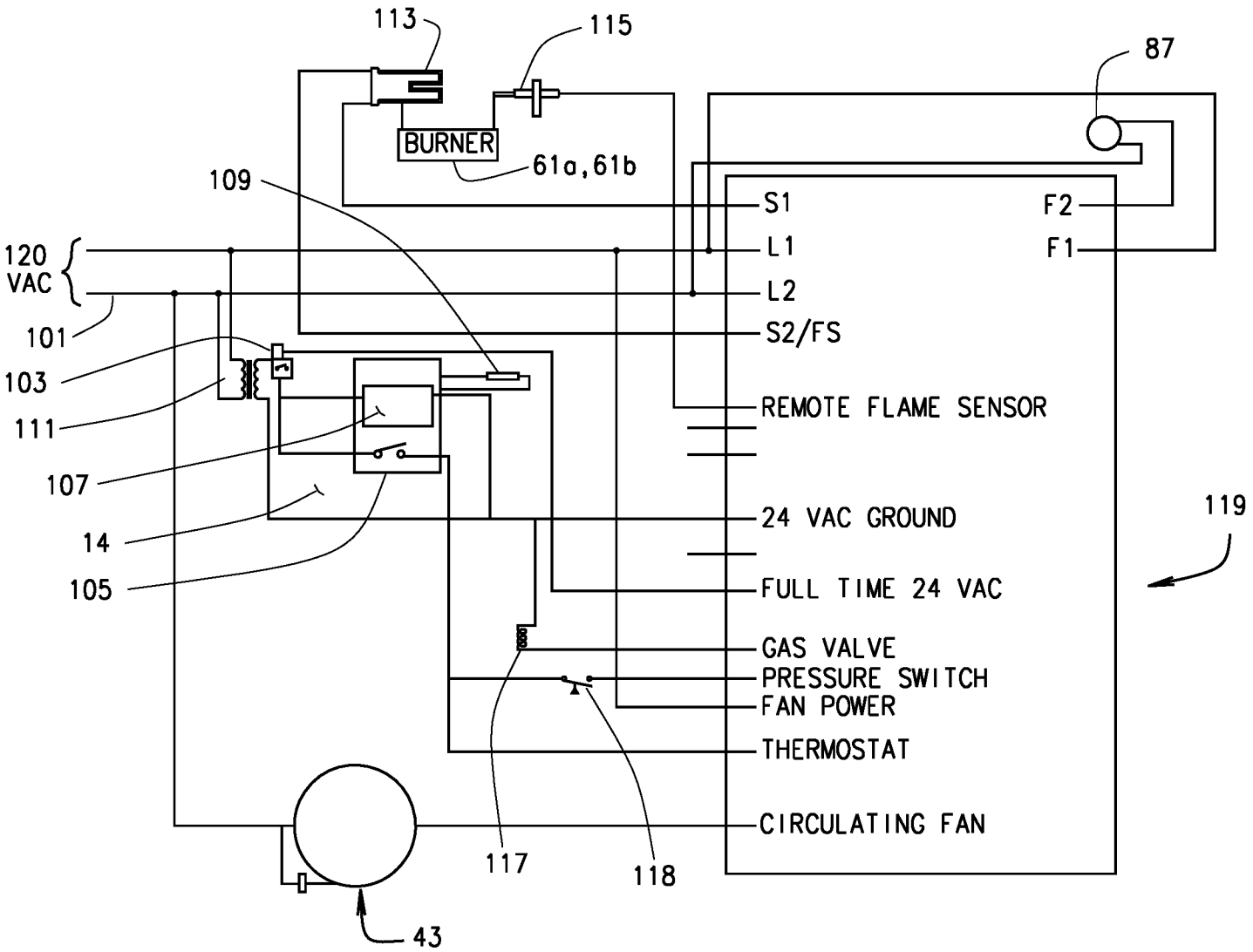
FIG. 18 is an electrical schematic for controlling the window heater of the present disclosure.

Referring now to FIG. 18, an electrical circuit is illustrated for controlling operation of heater 1. As indicated at 101, an electrical power cord is provided that has a convention 120 VAC male plug thereon (not shown) that may be plugged into a conventional electrical outlet. Within control panel 14 that is provided on front cover 9 has an on/off rocker switch 103 that turns heater 1 on or off. A thermostat 105 having a display 107 is mounted in control panel 14. The thermostat has a temperature sensor 109, such as a suitable thermistor, that is mounted to sense the temperature of the room air, preferably within the room air intake 11 to blower 43. A transformer 111 steps down the 120 volt AC power to 24 volts. Each burner 61*a*, 61*b* has a hot surface igniter 113 and a flame sensor 115 that are positioned relative to the flame in these burners to, respectively; ignite the gaseous fuel in the burner and to sense that the burner is lit and continues to burn. A gas valve 117, preferably an electrically operated solenoid valve, is provided to supply gaseous fuel (propane or natural gas) to the burners in the conventional manner upon the call for heat by thermostat 105 in a manner as will be described. Operation of the window heater 1 is preferably controlled by a suitable controller, as generally indicated at 119, such as a Series 35-67 24 VAC microprocessor based HIS control with combustion blower relay, as commercially available from Fenwal Controls, Ashland, Massachusetts However, other suitable control systems may be used with the heater of the present disclosure.

To prevent excessively rapid cycling of the heater 1 when the temperature is near the setpoint, thermostat 105 preferably has some temperature hysteresis. Instead of changing from "on" to "off" and vice versa instantly at the set point temperature, a thermostat with such hysteresis will not switch until the temperature within the room being heated to a little below the set point temperature and will not terminate operation of the heater until the temperature of the room increases a little above the set point temperature. For example, if the thermostat 105 of heater 1 is set to call for heat when the temperature in the room drops below 68° F., the burners 61*a*, 61*b* will not fire until the thermostat senses a temperature in the room of, say 67° F., and it may continue to heat the room until the thermostat senses the room temperature to be 69° F. This reduces the risk of rapid cycling of the heater and will avoid excessive equipment wear and tear resulting from such rapid cycling while still maintaining system temperature oscillation within a desired temperature range.

As described, heater 1 has an air gap between inner cabinet 5 and outer cabinet 7. While not shown, a suitable thermal insulation may optionally be placed within this air gap. The air gap maintains the temperature of the outer cabinet to a low temperature such that it may be installed in contact with combustible materials for mounting purposes and still would be in conformance with applicable safety regulations. With heater 1 installed in a window W, all fuel piping, whether the fuel source is a portable propane tank 49, or a propane or natural gas line installed in the home or building in which heater 1 is to be used, is located outside of the building in conformance with local codes.

In operation, with heater 1 installed in a window opening W of a room to be heated, and with a gas supply (e.g., tank 49) connected regulator 51 and with the electrical plug 101 plugged into an electrical receptacle; the controller 119 will be powered up when switch 103 is turned to the "on" position. This will supply 24 volt power to the microprocessor in controller 119 and the controller will initiate a self-check routine. If the sensor 109 senses that the temperature of the room air is below a predetermined set point input to in thermostat 105, the thermostat will generate a call for heat that is detected by controller 119. The controller will verify that pressure switch 118 and will turn on and will generate a signal if the exhaust fan 87 is turned on. After a so-called pre-purge delay, power will be applied to the hot surface igniter 113. When a predetermined current is passing through the ignition element of the igniter such that the ignition element reaches a predetermined temperature sufficient to ignite the gaseous fuel, a short dwell time will pass to make sure that the igniter element is up to temperature. After this dwell time, the gas valve 117 will open allowing gas to flow through the burners 61*a*, 61*b*. If the flame sensors 115 senses that a flame is present in each of the burners, the gas will remain open. The hot products of combustion from the burners enter and are drawn into the heat exchange tubes 79*a*, 79*b* and blower 43 is operated to draw room air into heating chamber 39 where the air flows over and around the heat exchange tubes and is heated by the heat exchange tubes. The heated air is forced out of the heating chamber and into discharge passageway 37 and is discharged back into the room via outlet 13 in the front cover 9. Such heating will continue so long as flame sensor 115 senses a flame and so long as the thermostat continues to call for heat. The exhaust gases and products of combustion are drawn through heat exchange tubes 79*a*, 79*b* by exhaust fan 87 and are discharged to the atmosphere via vent 93. Upon the temperature within the room reaching a desired temperature, the controller 119 via temperature sensor 109 will sense that heat is no longer needed, the controller will close gas valve 117. The controller will await the next call for heat. Exhaust fan 87 may remain on for a short period to insure that the products of combustion in the heat exchange tubes are exhausted to the atmosphere.

It will be particularly noted that with the window heater 1 of the present disclosure installed in a window W, there is no need to form a hole in the wall of the room to be heated to install the heater 1 or to vent the products of combustion to the atmosphere. Instead, the heater 1 need only be mounted or installed in a window W in the same manner as a window air conditioner. If the source of fuel for the heater 1 is a container for liquid propane, there need not be a fuel line that is run to the room. The container of liquid propane may be a conventional 15 or 20 pound container, such as is used for barbecue grills or in travel trailers, and the container is supplied with a conventional hose and pressure regulator for regulating the supply of gaseous fuel to a desired pressure so that it may be burned in burners 61*a*, 61*b*. It will be appreciated that the propane container may remain on the ground outside of the room that is heated by heater 1. Of course, heater 1 may be readily removed from the window in one room and installed in the window of another room, as desired, and the fuel container may be disconnected from heater 1 to facilitate moving the heater and then reconnected to the heater when the heater is installed in another window. If a permanent supply of natural gas or propane is available, heater 1 may be connected to such supply and the portable tank 49 would not be needed. Heater 1 preferably has a heat capacity of about 16,000-24,000 BTU/hour.

While the heater of the present disclosure has been described by reference to a specific embodiment, those skilled in the art will understand that modifications and variations of this heater may be constructed and used without departing from the scope of the claims below.

The invention claimed is:

1. A heater comprising:

a front cover;

a cabinet;

the front cover and the cabinet being configured to be attached together in an opening in an outside wall of a building with the front cover positioned in a room at an interior side of the outside wall and the cabinet positioned in an outside atmosphere at an exterior side of the outside wall, the cabinet having a heating chamber therein with one or more tubular heat exchangers configured to be located within the heating chamber and configured to be sealed with respect to said heating chamber, a gas burner for each of said tubular heat exchangers, each gas burner having a burner inlet and a burner outlet, each burner inlet is configured to be located outside of said heating chamber and in communication with the outside atmosphere when said heater is installed in said opening in an outside wall, a gas source for said burners, a gas supply line from said gas source and one or more gas connections configured to be connected to each of said burner inlets for supplying gas from said gas source to each of said burner inlets with the gas supply line and all of said gas connections being configured to be located exteriorly of said heating chamber so as to be in communication with the outside atmosphere when the heater is installed in said opening in an outside wall, each of said tubular heat exchangers having a heat exchanger inlet and a heat exchanger outlet, each said heat exchanger inlet being configured to be sealably connected to a respective said burner outlet so as to receive hot products of combustion from its respective burner and to convey said hot products of combustion through said heat exchangers thereby to heat air in said heating chamber, and wherein the outlet of each of said heat exchangers is configured to be sealably connected to an outlet from said heating chamber for exhausting the products of the combustion to the atmosphere outside of the room when said heater is installed in said opening in an outside wall and is operating, said heater further having a blower configured to draw room air into said heating chamber to be heated by said one or more tubular heat exchangers and configured to discharge heated air into the room; and wherein the heating chamber, the tubular heat exchangers located in the heating chamber, the gas burner for each said tubular heat exchanger and the gas connection connected to each gas burner are all configured to be positioned inside the cabinet and are configured to be positioned in the outside atmosphere at the exterior side of the outside wall when the front cover and the cabinet are attached together in the opening in the outside wall.

2. The heater as set forth in claim 1 wherein each of said tubular heat exchangers is a generally M-shaped tube within said heating chamber and having at least two straight runs and at least one U-shaped bend that connects said two straight runs, one end of one of the straight runs constituting said heat exchanger inlet end, and another end constituting said heat exchanger outlet.

3. The heater as set forth in claim 2 wherein said blower is configured to draw room air into the heating chamber through a room air inlet, to flow the room air through the heating chamber to be heated by said heat exchangers to a heated room air outlet for discharging heated air back into the room, said M-shaped tube being disposed within said heating chamber with at least one of said U-shaped bends being proximate said room air inlet such that room air to be heated is configured to flow within the heating chamber in a direction that is generally perpendicular to the U-shaped bend proximate said air inlet and then in a direction generally parallel along said straight runs.

4. The heater as set forth in claim 1 wherein a discharge passageway is provided within said cabinet, said discharge passageway being configured to receive air from said heating chamber heated by said tubular heat exchangers within said heating chamber and to discharge heated air into the room.

5. The heater as set forth in claim 1 further comprising a control system for the heater, said control system having a thermostat configured to establish a temperature below which said heater is operated to supply heat and a temperature above which the heater will be turned off.

6. The heater as set forth in claim 1 configured to be sealed with respect to an opening in an outside wall of a room to be heated such that the top, bottom and sides of the cabinet are sealed relative to the opening.

7. The heater as set forth in claim 1 wherein said gas supply comprises a container of liquid propane that is readily connected to said gas supply line.

8. The heater as set forth in claim 1 wherein said cabinet comprises an inner cabinet and an outer cabinet with an air gap therebetween.

9. The heater as set forth in claim 1 further comprising said front cover having an air inlet opening configured so that upon operation of the blower room air is forced into said heating chamber to be heated and an air outlet opening configured to discharge air heated within said heating chamber back into the room.

10. A heater comprising:

a front cover;

a cabinet;

the front cover and the cabinet being configured to be attached together in an opening in an outside wall of a building with the front cover positioned in a room at an interior side of the outside wall for heating the room and the cabinet positioned in an outside atmosphere at an exterior side of the outside wall, the cabinet having an inner and outer cabinet with an air gap therebetween, the inner cabinet having a heating chamber therein, said heating chamber having a back wall, a burner configured to be mounted on said back wall so as to be outside of the room and exposed to the atmosphere when the heater is installed in said opening in an outside wall, said burner having a burner inlet and a burner outlet with a combustion nozzle therebetween, a supply of gaseous fuel configured to be connected to said burner by a fuel coupler, an igniter configured to ignite said gaseous fuel in said burner, the burner outlet being configured to be in sealed communication with a heat exchange tube positioned within said heating chamber, said heat exchange tube having a heat exchange tube inlet configured to be in sealed communication with a respective burner outlet to receive hot products of combustion from said burner and a heat exchange outlet configured to discharge the products of combustion from said burner to the atmosphere when said heater is operating, said heater having a blower configured to draw room air from within the room into the heating chamber, configured to force said room air over and around said heat exchange tube within said heating chamber for being heated by said heat exchange tube, and configured to discharge air heated back into the room, said fuel supply, said burner, and said fuel coupler being configured to be located exteriorly of said heating chamber such that with said heater installed in said opening in an outside wall said fuel supply, said burners, and said fuel coupler are open to the atmosphere; and wherein the heating chamber, the heat exchange tube positioned within the heating chamber, the burner in communication with the inlet of the heat exchange tube and the igniter configured to ignite fuel inside the burner are all configured to be positioned inside the cabinet and are configured to be positioned in the outside atmosphere at the exterior side of the outside wall when the front cover and the cabinet are attached together in the opening in the outside wall.

11. The heater as set forth in claim 10 further having, said front cover including an air intake opening configured so that said blower can draw room air from the room and into said heating chamber for being heated by said heat exchange tube, said front cover further having an air outlet opening configured to discharge heated air into the room.

12. The heater of claim 1, further comprising:

the opening in the outside wall is a window opening.

13. The heater of claim 1, further comprising:

the interior side of the outside wall is in a room of a building.

14. The heater of claim 1, further comprising:

the exterior side of the outside wall is outside a building.

15. The heater of claim 10, further comprising:

the opening in the outside wall is a window opening.

16. The heater of claim 10, further comprising:

the interior side of the outside wall is in a room of a building.

17. The heater of claim 10, further comprising:

the exterior side of the outside wall is outside a building.

18. A method of attaching a heater in an opening in an outside wall of a building, the heater comprising a front cover and a cabinet that are configured to be attached together in an opening in an outside wall of a building, the cabinet having a heating chamber therein with one or more tubular heat exchangers configured to be located within the heating chamber, a gas burner for each of the tubular heat exchangers, each gas burner having a burner inlet and a burner outlet, each burner inlet is configured to be located outside of the heating chamber and in communication with the outside atmosphere when the heater is installed in an opening in an outside wall of a building, a gas source for the burners, a gas supply line from the gas source to gas connections that are configured to be connected to each of the burner inlets for supplying gas from the gas source to each of the burner inlets, the gas supply line and the gas connections being configured to be located exteriorly of the heating chamber so as to be in communication with the outside atmosphere when the heater is installed in an opening in and outside wall of a building, each of the tubular heat exchangers having a heat exchanger inlet and a heat exchanger outlet, each of the heat exchanger inlets being configured to be connected to a burner outlet so as to be capable of receiving hot products of combustion from the burner and to be capable of conveying the hot products of combustion through the tubular heat exchanger thereby to heat air in the heating chamber, and wherein the outlet of each of the tubular heat exchangers is configured to be connected to an outlet from the heating chamber for exhausting the products of combustion to the atmosphere outside of the room when the heater is installed in an opening in an outside wall of a building and is operating, the method comprising:

attaching the front cover and the cabinet of the heater together in the opening in the outside wall of the building with the front cover positioned in a room at an interior side of the outside wall and the cabinet positioned in an outside atmosphere at an exterior side of the outside wall; and wherein the heating chamber, the tubular heat exchangers positioned inside the heating chamber and the gas burners connected to the inlets of the tubular heat exchangers are all positioned inside the cabinet and are positioned in the outside atmosphere at the exterior side of the outside wall when the front cover and the cabinet are attached together in the opening in the outside wall.

19. The method of claim 18, further comprising:

attaching the front cover and the cabinet together in a window opening in the outside wall of the building with the front cover positioned in the room at the interior side of the outside wall for heating the room and the cabinet positioned in the outside atmosphere at the exterior side of the outside wall.

20. The method of claim 18, further comprising:

locating the gas source at the exterior side of the outside wall outside the building.

* * * * *